US008414348B2

(12) United States Patent
Weems

(10) Patent No.: US 8,414,348 B2
(45) Date of Patent: Apr. 9, 2013

(54) RECONFIGURABLE ROTATABLE PERFORMANCE DEVICE

(75) Inventor: Kyle Weems, San Marcos, TX (US)

(73) Assignee: Flambeau, Inc., Baraboo, WI (US)

( * ) Notice: Subject to any disclaimer, the term of this patent is extended or adjusted under 35 U.S.C. 154(b) by 308 days.

(21) Appl. No.: 12/704,595

(22) Filed: Feb. 12, 2010

(65) Prior Publication Data

US 2010/0210174 A1 Aug. 19, 2010

Related U.S. Application Data

(60) Provisional application No. 61/152,325, filed on Feb. 13, 2009.

(51) Int. Cl.
*A63H 27/127* (2006.01)

(52) U.S. Cl. ..... 446/255; 29/426.1

(58) Field of Classification Search ..... 446/255
See application file for complete search history.

(56) References Cited

U.S. PATENT DOCUMENTS

| | | | | |
|---|---|---|---|---|
| 116,773 | A | 7/1871 | Sumner | |
| 903,419 | A | 11/1908 | Skeer | |
| 1,554,781 | A | 9/1925 | Blecker | |
| 2,030,302 | A | 2/1936 | Jones | |
| 2,680,933 | A | 6/1954 | Laurens et al. | |
| 2,774,354 | A | 5/1956 | Watkins et al. | |
| 3,076,287 | A | 2/1963 | Jermyn | |
| 3,175,326 | A | 3/1965 | Isaacson | |
| 3,314,409 | A | 4/1967 | Olson | |
| 3,341,969 | A | 9/1967 | Olson | |
| 3,653,148 | A | 4/1972 | Finkel | |
| 3,728,813 | A | 4/1973 | Jolliffe | |
| 3,883,985 | A | 5/1975 | Dawson, Jr. | |
| 4,452,007 | A | 6/1984 | Martin | |
| 5,951,361 | A | 9/1999 | Van Dan Elzen et al. | |
| 5,984,759 | A | 11/1999 | O'Sullivan | |
| 6,113,456 | A | 9/2000 | Hadzicki et al. | |
| 6,220,920 | B1 | 4/2001 | Baier | |
| 6,234,861 | B1 | 5/2001 | Ichii et al. | |
| 6,565,408 | B1 * | 5/2003 | Marcantonio et al. | 446/250 |
| 7,149,281 | B2 | 12/2006 | Lacherade et al. | |
| 7,175,500 | B1 | 2/2007 | Difeo | |
| 2005/0287910 | A1 | 12/2005 | O'Sullivan | |
| 2009/0258568 | A1 * | 10/2009 | Hochstrasser | 446/250 |

* cited by examiner

*Primary Examiner* — Michael Dennis
(74) *Attorney, Agent, or Firm* — Quarles & Brady LLP

(57) ABSTRACT

A rotatable device for performing maneuvers as the rotatable device rotates is disclosed. The device comprises a rotatable assembly that includes a first lobe and a second lobe, an intermediate assembly between the first lobe and second lobe, and a first spacer between the intermediate assembly and the first lobe. The first spacer includes a first surface. In a first configuration, the first spacer defines an interference fit with the intermediate assembly. In a second configuration wherein the first spacer is reversed relative to the first configuration, the first surface defines a loose fit with the intermediate assembly.

19 Claims, 8 Drawing Sheets

RECONFIGURABLE ROTATABLE PERFORMANCE DEVICE

CROSS-REFERENCE TO RELATED APPLICATION

This application claims the benefit of U.S. Provisional Patent Application No. 61/152,325 filed Feb. 13, 2009, the disclosure of which is hereby incorporated by reference in its entirety.

STATEMENT REGARDING FEDERALLY SPONSORED RESEARCH OR DEVELOPMENT

Not applicable.

BACKGROUND OF THE INVENTION

The invention relates to rotatable performance devices used for entertainment. Rotatable performance devices, such as diabolos, yo-yos, and the like, are well known entertainment devices for performing maneuvers or tricks. Diabolos are used with a string that engages an axle of the device, and the diabolo balances on the string due to gyroscopic effects while spinning The string is typically connected between two sticks, and a single stick is held in each hand of a user. The user raises a single hand, typically the right hand for a right-handed user, to accelerate the diabolo. After the diabolo begins spinning, the user may perform maneuvers such as tossing the diabolo in the air and catching it on the string, swinging the diabolo around in a large circle, and the like.

Traditional diabolos include a fixed axle between shell sections having a relatively small diameter. The fixed axle engages the string to support the diabolo and transmit motion from the string to the shell sections. However, many maneuvers and tricks require the axle to slide over the string, and as a result, the diabolo slows due to friction between the axle and the string. The best diabolo performances are considered to be those where the user does not need to constantly accelerate the diabolo, and therefore, friction between the axle and the string may prevent a user from achieving such performances.

Previous designs have been created to address the effect of friction between the axle and the string on diabolo performance. An example of such a design is a diabolo having a one-way bearing assembly. The one-way bearing is positioned radially outwardly from an inner axle fixed relative to the shell sections. An outer axle fixed to the one-way bearing engages the string during use of the diabolo. The one-way bearing includes rollers that permit the one-way bearing and the outer axle to rotate in a first direction relative to the inner axle. The rollers also prevent the one-way bearing and the outer axle from rotating relative to the inner axle in a second direction opposite the first direction. As a result, the one-way diabolo can be accelerated by rotating the outer axle in the second direction. Thereafter, the shell sections continue to rotate and the outer axle can remain in contact with the string without slipping.

One-way diabolos advantageously permit the shell sections to spin for much longer periods and reduce the need to consistently accelerate the diabolo. However, some users prefer not to use one-way diabolos since the one-way motion prevents certain maneuvers from being performed, such as maneuvers in which the diabolo climbs the string. Further still, some users own both fixed axle diabolos and one-way diabolos so that the appropriate type of diabolo can be used for different maneuvers.

Considering the limitations of previous designs, it would be desirable to have a rotatable performance device that is capable of being used as a fixed axle rotatable performance device and a one-way rotatable performance device in which an outer axle is configured to rotate relative to another section of the device. Such a rotatable performance device would be versatile relative to previous designs.

SUMMARY OF THE INVENTION

In one aspect, the present invention provides a rotatable device for performing maneuvers as the rotatable device rotates. The device comprises a rotatable assembly that includes a first lobe and a second lobe, an intermediate assembly between the first lobe and second lobe, and a first spacer between the intermediate assembly and the first lobe. The first spacer includes a first surface. In a first configuration, the first spacer defines an interference fit with the intermediate assembly. In a second configuration wherein the first spacer is in a reversed position relative to the first configuration, the first surface defines a loose fit with the intermediate assembly.

In another aspect, the device comprises a first shell assembly, a second shell assembly opposite the first shell assembly, an inner axle connecting the first and second shell assemblies, and an outer axle rotatably disposed radially outwardly from the inner axle. A configurable first spacer between the first shell assembly and the outer axle is disposed radially outwardly from the inner axle. The first spacer is configurable to be oriented in a first configuration in which the first spacer engages the outer axle to fix the outer axle relative to the inner axle. The first spacer is also configurable to be oriented in a second configuration in which the first spacer permits the outer axle to rotate relative to the inner axle.

In yet another aspect, the present invention provides a method of manually disassembling a rotatable device having a rotatable assembly including a first lobe and a second lobe. At least the first lobe includes a first access handle having a first threaded section. The rotatable device also has an intermediate assembly between the first and second lobes. The intermediate assembly includes a first complimentary threaded section to connect to the first threaded section. The method includes the steps of disengaging the first access handle from the intermediate assembly, removing the first access handle from the device, and separating the first lobe from the intermediate assembly.

The foregoing and other objects and advantages of the invention will appear in the detailed description that follows. In the description, reference is made to the accompanying drawings that illustrate a preferred embodiment of the invention.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
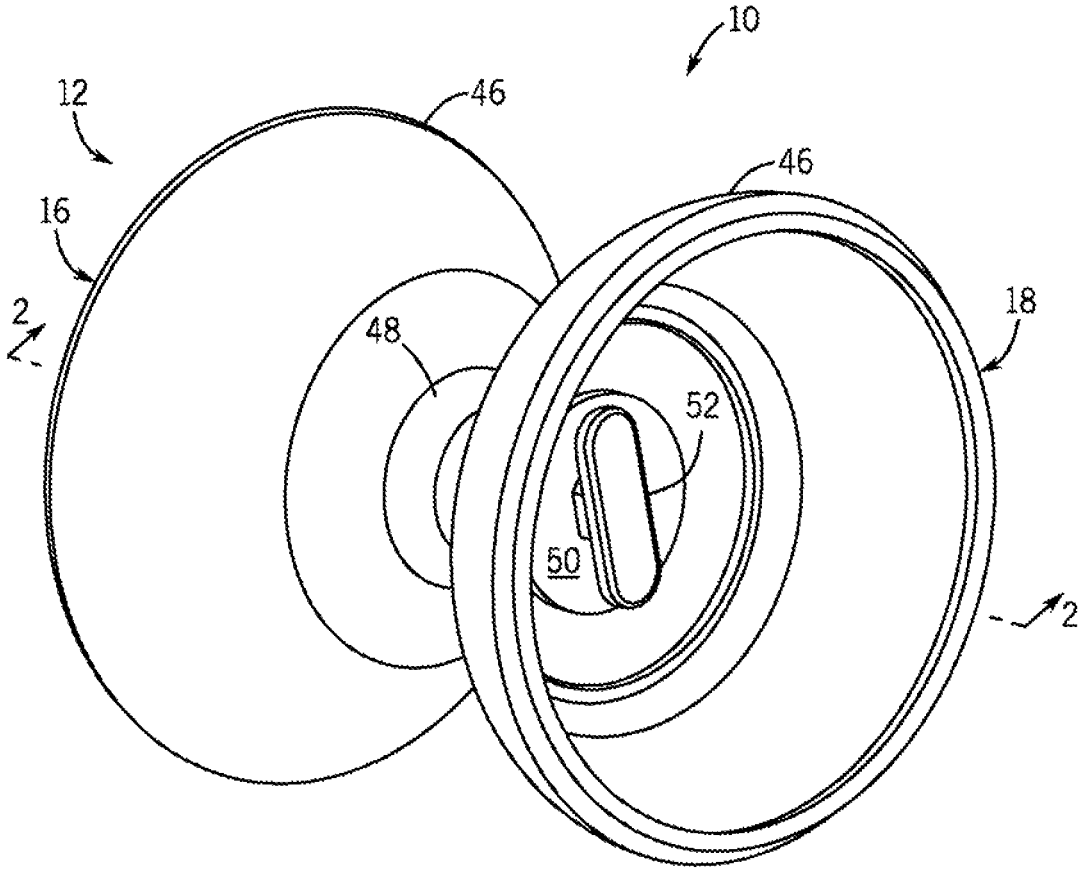
FIG. 1 is a perspective view of a rotatable device of the present invention.

In the detailed description that follows, it should be noted that the device of the present invention can be easily disassembled and reconfigured by a user. To describe the relationship among the device components, certain connecting terms such as "fixed" and "rotatable" are used occasionally. It should be understood that these terms do not describe permanent connections between components. Instead, these terms describe connections when the components are adequately secured to one another to prevent the device from inadvertently disassembling during use.

Referring to FIGS. 1-4, the device 10 of the present invention includes a rotatable assembly 12, an intermediate assembly 14 (FIGS. 2-4) between a first lobe 16 and a second lobe 18 of the rotatable assembly 12, and, in an exemplary embodiment, one or more spacers 20 (FIGS. 2-4) between the rotatable assembly 12 and the intermediate assembly 14. The spacers 20 may be configured to face either direction and thereby permit the intermediate assembly 14 to rotate in alternative directions. For example, the spacers 20 may provide a rotatable performance device 10 that is a fixed axle diabolo in a first configuration and a one-way diabolo in a second configuration. This and other aspects of the invention are described in further detail below.

Figure 2:
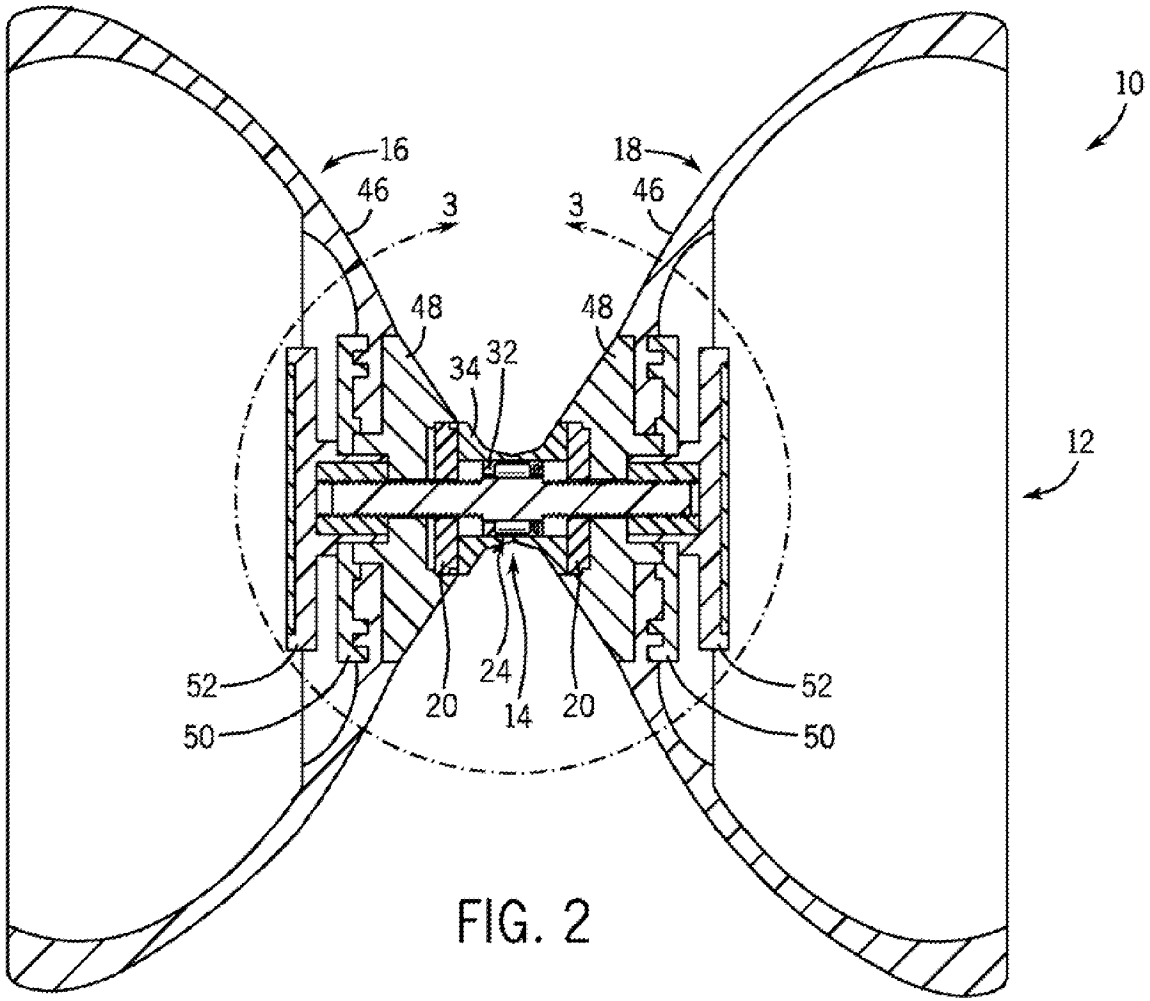
FIG. 2 is a side sectional view along the line 2-2 of FIG. 1.
Figure 3:
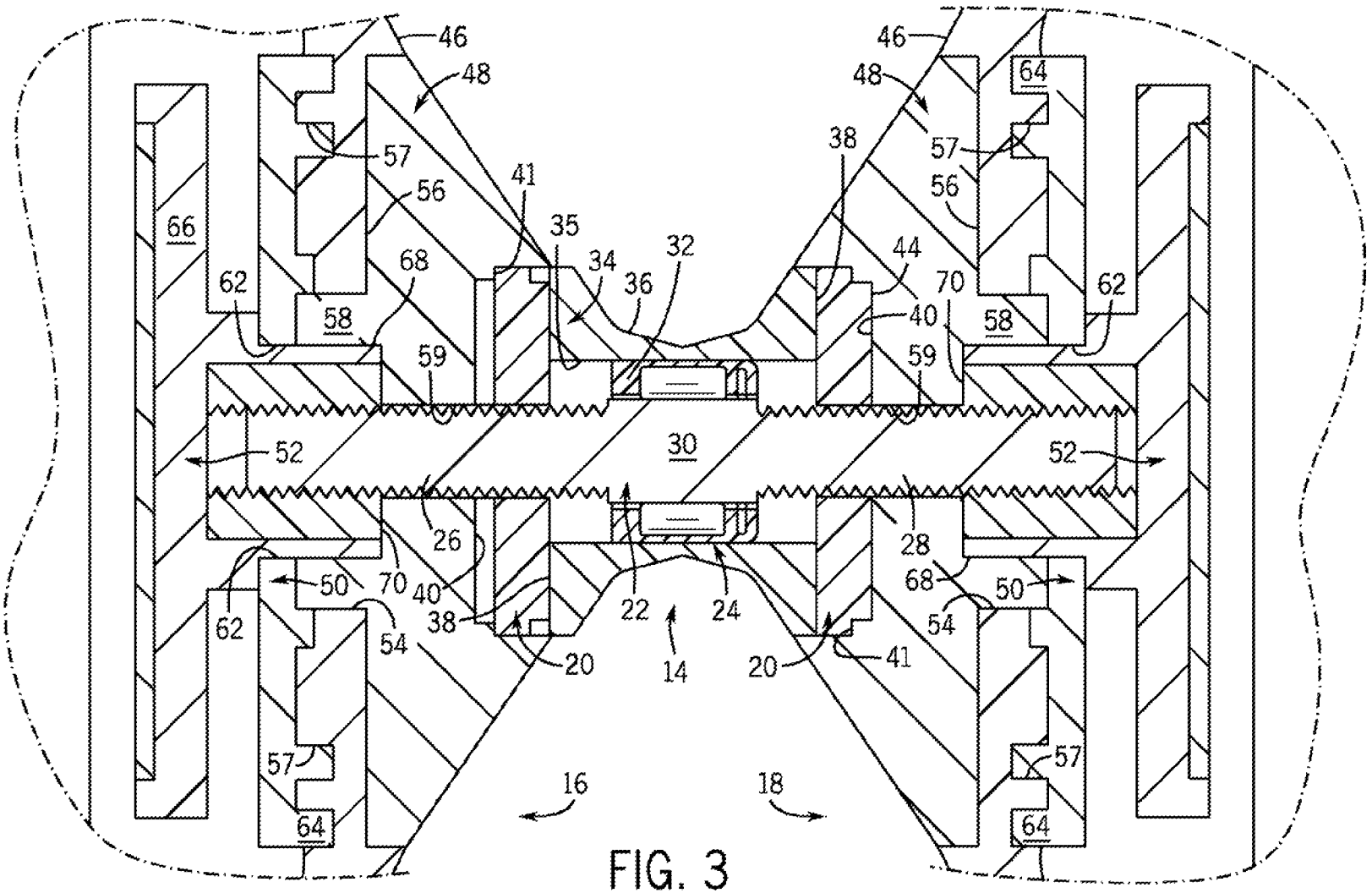
FIG. 3 is a detail view of the area 3-3 of FIG. 2
Figure 4:
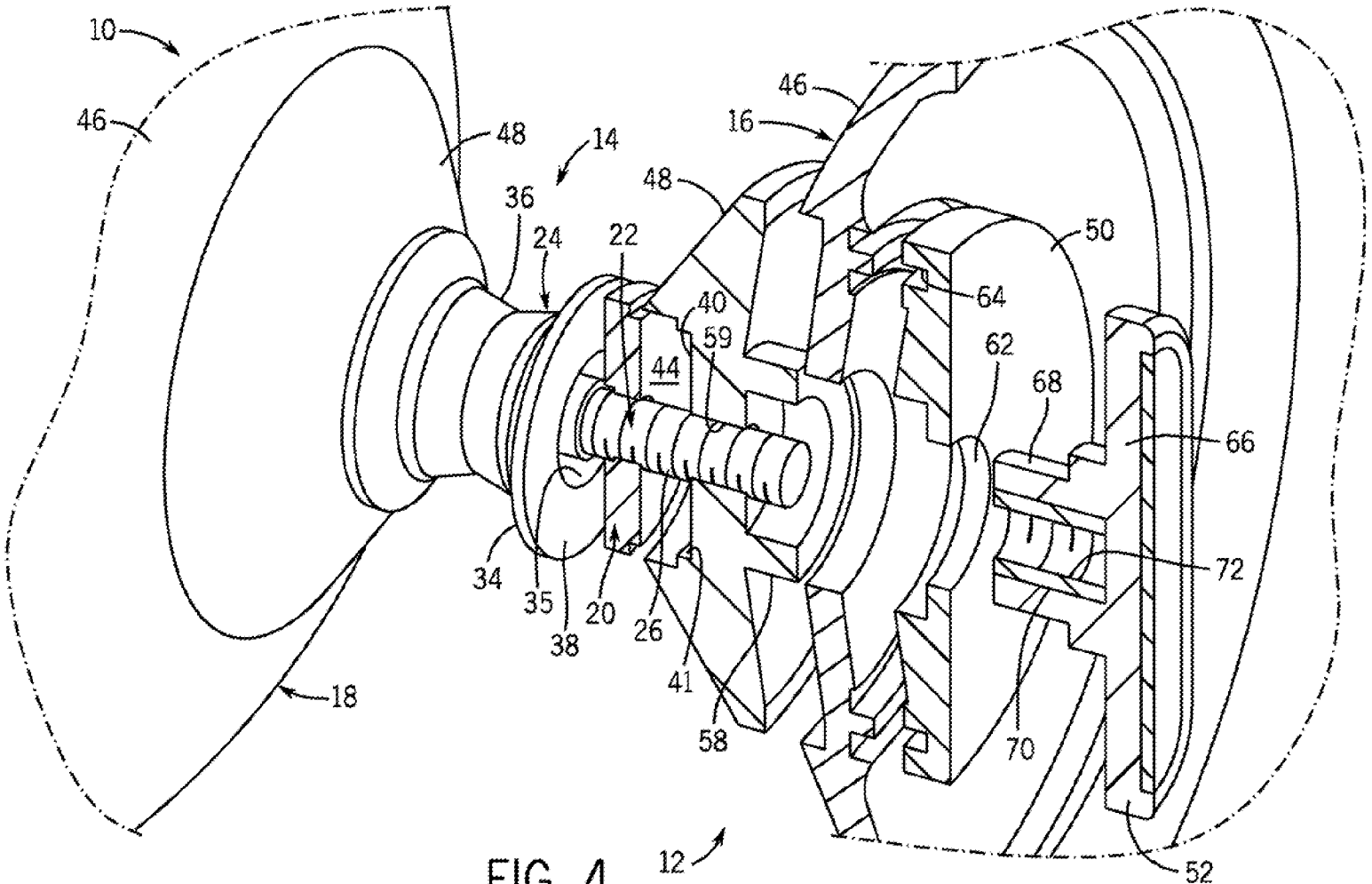
FIG. 4 is a partial sectional and exploded view along the line 2-2 of FIG. 1.

Referring to FIGS. 2-4, the intermediate assembly 14 includes an inner axle 22 that engages and is fixed relative to the rotatable assembly 12 and an outer axle 24 that is rotatable relative to the inner axle 22. The inner axle 22 is a generally elongated component having a first external threaded section 26 at a first end that threadably connects to the first lobe 16 and preferably passes through one of the spacers 20. The inner axle 22 also has a second external threaded section 28 at a second end that threadably connects to the second lobe 18 and preferably passes through another spacer 20. The inner axle 22 further includes an intermediate section 30 between the first external threaded section 26 and the second external threaded section 28.

The outer axle 24 includes a bearing 32 (FIG. 3) that engages the inner axle 22 and an outer member 34 that engages a string during use of the rotatable performance device 10. The bearing 32 is disposed radially outwardly from the intermediate section 30 and may be, for example, a one-way bearing that rotates relative to the inner axle 22 in only a first direction.

One-way bearings and their components, such as springs and rollers, are well known to those skilled in the art and, therefore, are not described in detail. The outer member 34 is disposed radially outwardly from the bearing 32 and is fixed relative to the bearing 32. That is, the outer member 34 has a hole 35 that has a diameter that, together with the outer diameter of the bearing 32, provides a secure fit between the outer member 34 and the bearing 32. The outer member 34 is preferably axisymmetric and preferably has a concave outer surface 36 to prevent the string from contacting the rotatable assembly 12. In addition, the outer member 34 has end surfaces 38 that preferably engage the spacers 20 in at least some configurations of the spacers 20.

Figure 5:
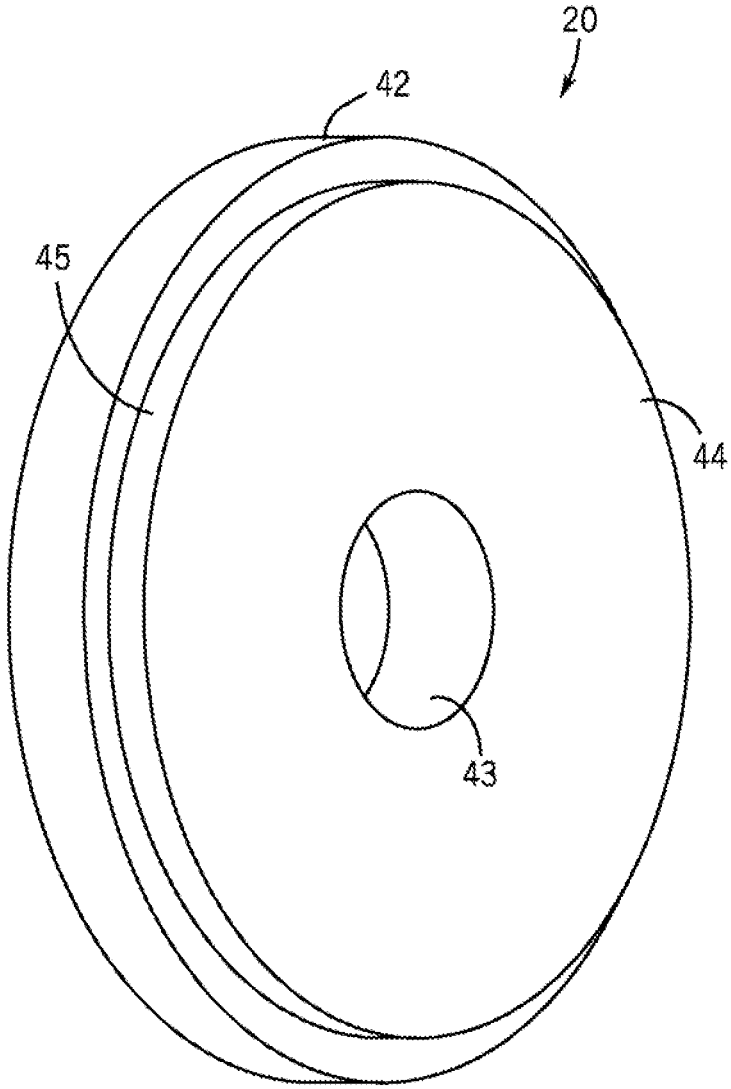
FIG. 5 is a perspective view of a spacer of the rotatable device of FIG. 1.

Still referring to FIGS. 2-4, the spacers 20 engage the outer member 34 in at least some configurations to fix the outer member 34 relative to the rotatable assembly 12. The spacers 20 may be positioned within recesses 40 of the rotatable assembly 12 and are preferably fixed relative to the rotatable assembly 12 during use of the device 10. Referring specifically to FIG. 5, the spacers 20 are preferably axisymmetric and include a main section 42, a first surface 44 adjacent a shoulder 45 that provides a diameter less than that of the main section 42, and a hole 43 through which the inner axle 22 extends.

As described above, the spacers 20 may provide a rotatable performance device 10 that is a fixed axle diabolo in a first configuration and a one-way diabolo in a second configuration. Specifically, in the first configuration, the spacers 20 may be positioned completely within the recesses 40 with the first surfaces 44 away from the outer member 34 as shown with the spacer 20 on the right side in FIG. 2. In the first configuration, the distance between the spacers 20 defines an interference fit with the outer member 34. As a result, the outer member 34 and the bearing 32 are fixed relative to the inner axle 22 and the rotatable assembly 12 in the first configuration. Both spacers 20 are preferably positioned completely within the recesses 40 to balance the rotatable performance device 10, although in some cases it may be sufficient to position one of the spacers 20 completely within one of the recesses 40 to fix the outer axle 24 relative to the rotatable assembly 12.

In the second configuration, the spacers 20 may be positioned within a recess 40 with the first surface 44 adjacent the outer member 34 as shown with the spacer 20 on the left side in FIG. 2. In addition, the main section 42 of each spacer 20 may engage a shoulder 41 within one of the recesses 40 in the second configuration, and the distance between the spacers 20 defines a loose fit with the outer member 34. As a result, the outer member 34 and the bearing 32 can rotate relative to the inner axle 22 in the second configuration.

To reconfigure the spacers 20 from one configuration to the other, one of the external threaded sections 26 and 28 is unthreaded from the rotatable assembly 12 to permit the spacers 20 and the outer axle 24 to be removed from the inner axle 22. One or more of the spacers 20 may be reconfigured thereafter to face the opposite direction to provide different motion of the intermediate assembly 14. The rotatable performance device 10 is reassembled by repositioning the outer axle 24 along the inner axle 22 and threading the inner axle 22 to the rotatable assembly 12.

Referring to FIGS. 2-4, the rotatable assembly 12 includes the first lobe 16 and the second lobe 18. In some embodiments and in the case of a diabolo, for example, the first and second lobes 16 and 18 may be first and second shell assemblies, respectively, that have generally concave shapes. The first and second lobes 16 and 18 are generally identical, and therefore, only the first lobe 16 will be described in detail. The first lobe 16 includes a lobe body 46, a proximal hub 48 generally disposed on a first side of the lobe body 46 and adjacent the spacer 20, a distal hub 50 generally disposed on a second side of the lobe body 46, and an access handle 52 that connects to the inner axle 22 and is generally disposed adjacent the distal hub 50 opposite the proximal hub 48. The lobe body 46, the proximal hub 48, the distal hub 50, and the access handle 52 preferably connect to one another tightly to provide a generally rigid first lobe 16. If the device 10 is a one-way diabolo in some configurations, the rotatable assembly 12 preferably includes an arrow (not shown) that indicates which half 16 or 18 should face the user during use of the device 10.

Referring first to FIGS. 1-4, the lobe body 46 is preferably axisymmetric as well as large and heavy relative to the other components of the rotatable performance device 10. In addition, the lobe body 46 is preferably shaped to provide a large moment of inertia so that the rotatable assembly 12 does not easily stop spinning due to friction forces within the device 10. Those skilled in the art will recognize effective shapes for the lobe body 46. For example, if the rotatable performance device 10 is a diabolo, the lobe body 46 may be a shell member that has a generally concave shape. Referring to FIG. 3, the lobe body 46 also includes a hole 54 through which other components extend, a recess 56 on a first side to accommodate the proximal hub 48, and ridges 57 on a second side to engage the distal hub 50.

Still referring to FIGS. 1-4, the proximal hub 48 has a generally frusto-conical shape, and includes the recess 40 that accommodates the spacer 20, a stand-off 58 that engages the access handle 52, and a hole 59 through which the inner axle 22 extends. The recess 40 preferably has a diameter that provides a loose fit with the main section 42 of the spacer 20. The recess 40 also preferably has the shoulder 41 that has a diameter that provides a loose fit with the shoulder 45 of the spacer 20. The shoulder 41 engages the spacer 20 and permits the spacer 20 to be positioned in different configurations as described above. Referring to FIG. 3, the outer member 34 may partially enter the recess 40 in the configuration in which the bearing 32 is fixed relative to the inner axle 22 to provide a generally continuous surface between the outer member 34 and the proximal hub 48. Similarly, the outer member 34 may be outside the recess 40 in the configuration in which the bearing 32 rotates relative to the inner axle 22. The stand-off 58 is disposed on an opposite side of the proximal hub 48 from the recess 40. The stand-off 58 extends through the hole 54 of the lobe body 46 and preferably has an external diameter that provides a loose fit with the hole 54. The stand-off 58 also preferably has an internal diameter that is sized to engage the access handle 52.

Still referring to FIGS. 1-4, the distal hub 50 has a generally disk-like shape, and includes a hole 62 through which the access handle 52 extends and circular ridges 64 adjacent the ridges 57 of the lobe body 46. Referring to FIGS. 3 and 4, the access handle 52 includes a handle section 66, an insert section 68 that extends through the distal hub 50 and into the stand-off 58 of the proximal hub 48, and a threaded insert 70 disposed within the insert section 68. The handle section 66 is a generally elongated section and preferably has a dimension, for example, the height of the handle section 66 as shown in FIG. 3, that is relatively large compared to the diameter of the inner axle 22. The height may be, for example, at least five times the diameter of the inner axle 22. A relatively large height advantageously permits a user to grasp the handle section 66 and disengage the access handle 52 from the inner axle 22, which ultimately permits the user to disassemble and reconfigure the rotatable performance device 10 without other tools. The threaded insert 70 includes an internal threaded section 72 to engage the first external threaded section 26 and may be, for example, a nut.

Figure 6:
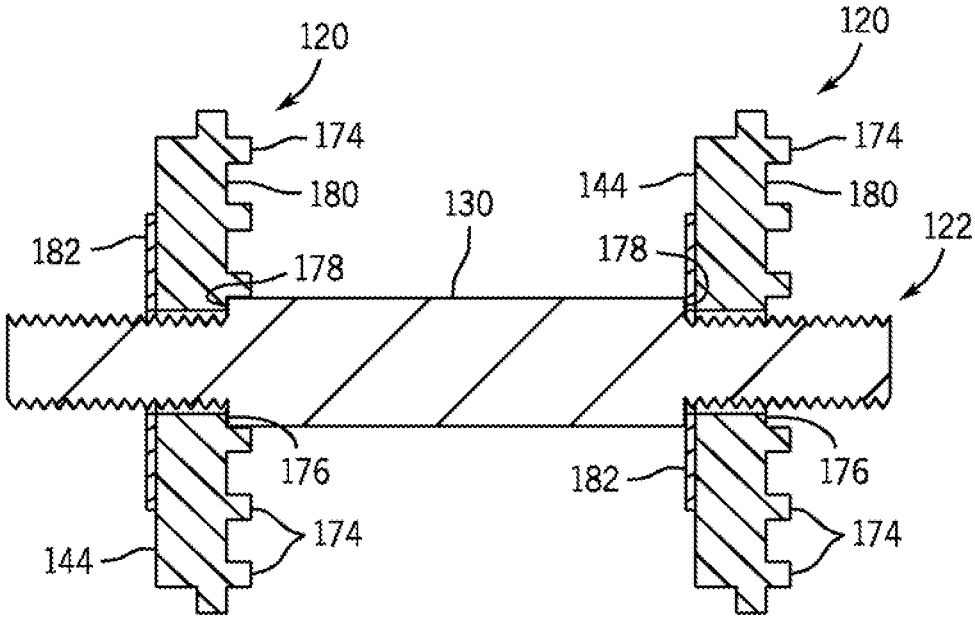
FIG. 6 is a side sectional view of components of a second embodiment of a rotatable device of the present invention.
Figure 7:
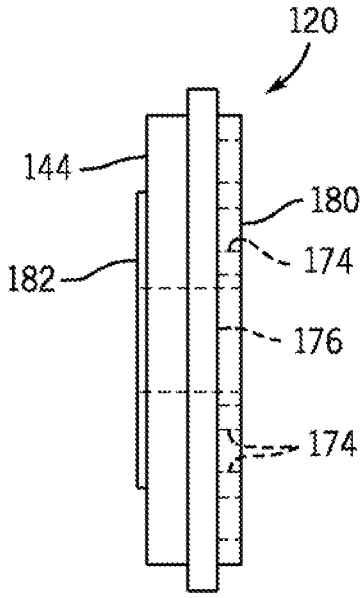
FIG. 7 is a side view of a spacer of the second embodiment of the rotatable device.

Referring to FIGS. 6 and 7, the spacers 120 and the inner axle 122 of a second embodiment of the rotatable performance device are shown. Other components of the device are generally identical to those described above, and therefore, are hidden for simplicity. Like the first embodiment 10 of the device, the spacers 120 may be reconfigured to provide different motion of the intermediate assembly 14. Referring to FIG. 6, the intermediate section 130 of the inner axle 122 is longer relative to that of the first embodiment 10 of the device so that the intermediate section 130 may engage the spacers 102. For example, the intermediate section 130 may have a length that is generally equal to the distance between the end surfaces 38 of the outer member 34 (FIG. 3). Ends 178 of the intermediate section 130 engage the spacers 120 to provide different configurations of the rotatable performance device. The interaction of the intermediate section 130 with the spacers 120 is described in further detail in the following paragraphs.

First and referring to FIG. 6, the spacer 120 on the left side of the drawing is shown in the first configuration. Each spacer includes a second surface 180 opposite the first surface 144. Each second surface 180 includes ridges 174 that engage the outer member 34 (FIG. 2) in the first configuration. Each second surface 180 also includes a recess 176 that accommodates the end 178 of the intermediate section 130. As a result, the ridges 174 extend past the end 178 of the intermediate section 130 and define an interference fit with the outer member 34 in the first configuration. The interference fit fixes the outer member 34 relative to the inner axle 122 and the rotatable assembly 12. Both of the second surfaces 180 are preferably positioned adjacent the outer member 34 to balance the rotatable performance device, although it may be sufficient to position only one of the second surfaces 180 adjacent the outer member 34 to fix the outer axle 24 relative to the rotatable assembly 12.

Second and still referring to FIG. 6, the spacer 120 on the right side of the drawing is shown in the second configuration. The first surface 144 of each spacer 120 preferably includes a washer or metal insert 182 that engages the end 178 of the intermediate section 130 in the second configuration. The distance between the first surfaces 144 preferably defines a loose fit with the outer member 34 in the second configuration. As a result, the first surfaces 144 provide a configuration in which the outer member 34 and the bearing 32 (FIG. 2) can rotate relative to the inner axle 122.

Regarding the second embodiment of the device, it should be noted that the recesses 40 (FIG. 3) preferably do not have shoulders 41 because the ridges 174 and the washer 182 provide the first and second configurations of the device, respectively.

The second embodiment of the device may also be a fixed axle diabolo in a first configuration and a one-way diabolo in a second configuration like the first embodiment 10. In addition, the second embodiment is preferably configured to be disassembled by hand due to, for example, the large access handles 52.

Figure 8:
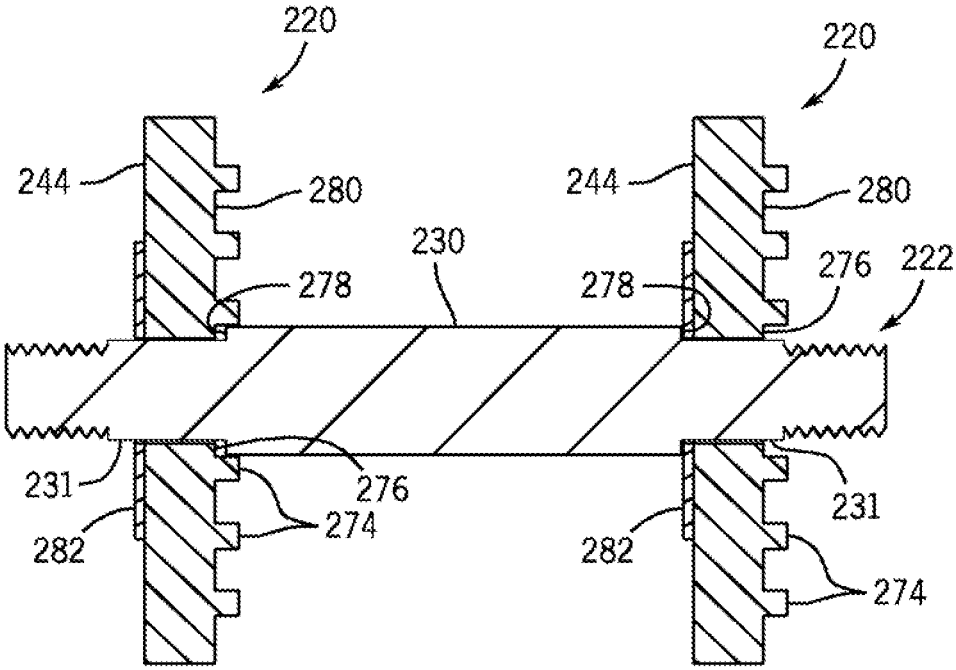
FIG. 8 is a side sectional view of components of a third embodiment of a rotatable device of the present invention.
Figure 9:
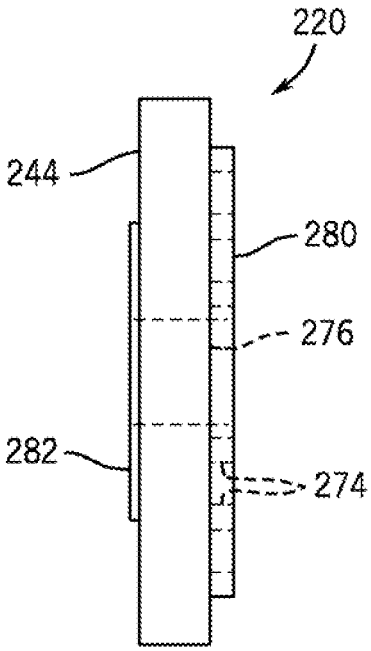
FIG. 9 is a side view of a spacer of the third embodiment of the rotatable device.

Referring to FIGS. 8 and 9, the spacers 220 and the inner axle 222 of a third embodiment of the rotatable performance device are shown. Other components of the device are generally identical to those described above, and therefore, are hidden for simplicity. Like the first embodiment 10 of the device, however, the spacers 220 may be reconfigured or reversed to provide different motion of the intermediate assembly 14. Referring to FIG. 8, the intermediate section 230 of the inner axle 222 is longer relative to that of the first embodiment 10 of the device. For example, the intermediate section 230 may have a length that is generally equal to the distance between the end surfaces 38 of the outer member 34 (FIG. 3). Ends 278 of the intermediate section 230 engage the spacers 220 to provide different configurations of the rotatable performance device. The interaction of the intermediate section 230 with the spacers 220 is described in further detail in the following paragraphs. The inner axle 222 may also include stepped sections 231 adjacent the ends 278 of the intermediate section 230 to limit radial movement of the spacers 220 relative to the inner axle 222.

First and referring to FIG. 8, the spacer 220 on the left side of the drawing is shown in the first configuration. Each spacer includes a second surface 280 opposite the first surface 244. Each second surface 280 includes ridges 274 that engage the outer member 34 (FIG. 2) in the first configuration. Each second surface 280 also includes a recess 276 that accommodates the end 278 of the intermediate section 230. As a result, the ridges 274 extend past the end 278 of the intermediate section 230 and define an interference fit with the outer member 34 in the first configuration. The interference fit fixes the outer member 34 relative to the inner axle 222 and the rotatable assembly 12. Both of the second surfaces 280 are preferably positioned adjacent the outer member 34 to balance the rotatable performance device, although it may be sufficient to position only one of the second surfaces 280 adjacent the outer member 34 to fix the outer axle 24 relative to the rotatable assembly 12.

Second and still referring to FIG. 8, the spacer 220 on the right side of the drawing is shown in the second configuration. The first surface 244 of each spacer 220 preferably includes a washer or metal insert 282 that engages the end 278 of the intermediate section 230 in the second configuration. The distance between the first surfaces 244 preferably defines a loose fit with the outer member 34 in the second configuration. As a result, the first surfaces 244 provide a configuration in which the outer member 34 and the bearing 32 (FIG. 2) can rotate relative to the inner axle 222.

Regarding the third embodiment of the device, it should be noted that the recesses 40 (FIG. 3) preferably do not have shoulders 41 because the ridges 274 and the washer 282 provide the first and second configurations of the device, respectively.

The third embodiment of the device may also be a fixed axle diabolo in a first configuration and a one-way diabolo in a second configuration like the first embodiment 10. In addition, the third embodiment is preferably configured to be disassembled by hand due to, for example, the large access handles 52.

Figure 10:
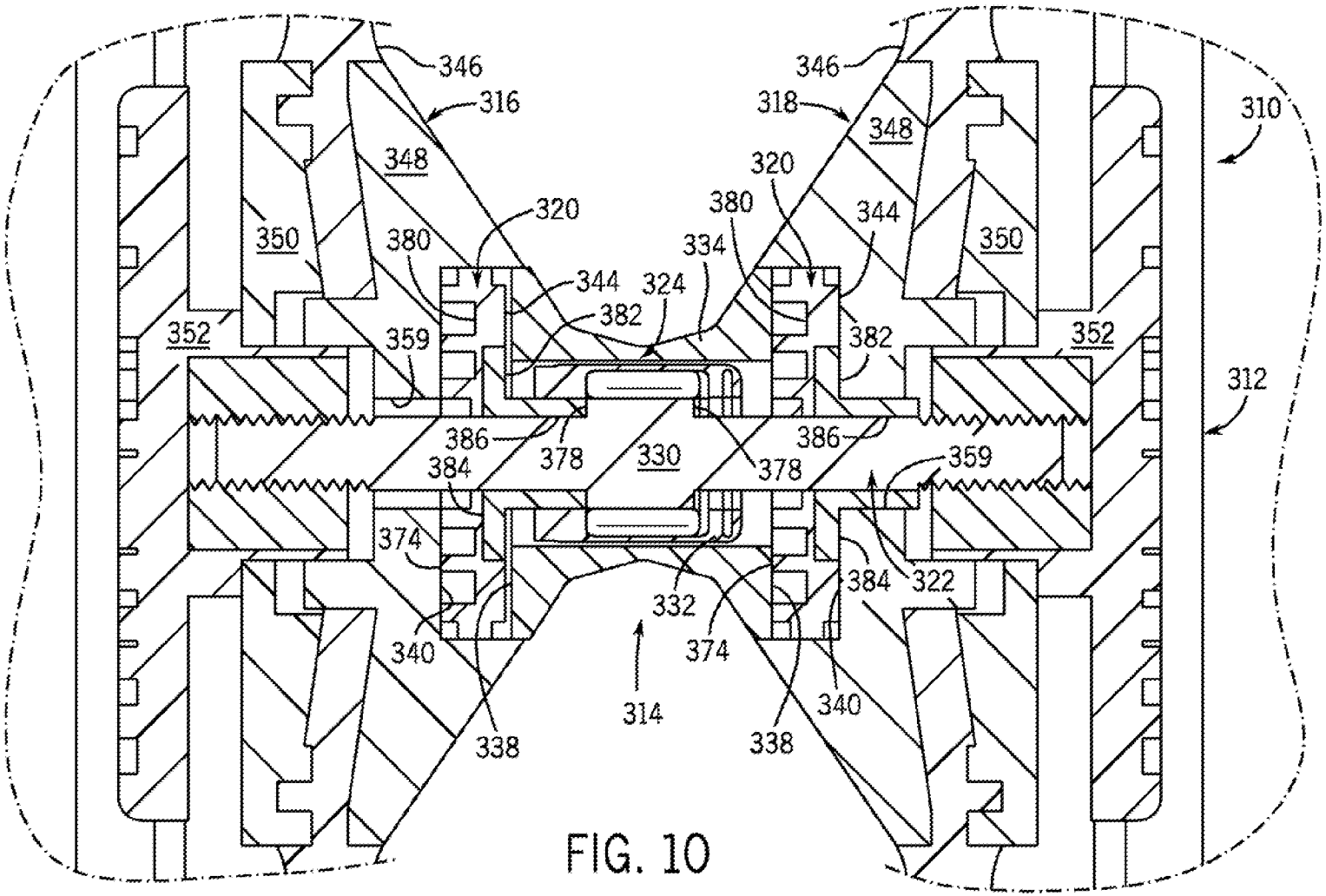
FIG. 10 is a side sectional view of a fourth embodiment of a rotatable device of the present invention.

Referring to FIG. 10, a fourth embodiment 310 of the rotatable performance device of the present invention includes a rotatable assembly 312, an intermediate assembly 314 between a first lobe 316 and a second lobe 318 of the rotatable assembly 312, and one or more spacers 320 between the rotatable assembly 312 and the intermediate assembly 314. Like the first embodiment 10 of the device, the spacers 320 may be reconfigured or reversed to provide different motion of the intermediate assembly 314. However, the structure of several components of the fourth embodiment 310 differ from that of the first embodiment 10. For example, the first surface 344 of each spacer includes an insert 382 that includes a disk section 384 and a cylindrical section 386. In some configurations, ends 378 of the intermediate section 330 of the inner axle 322 engage the cylindrical sections 386 to provide different motion of the intermediate assembly 314. The interaction of the intermediate section 330 with the spacers 320 is described in further detail in the following paragraphs.

Still referring to FIG. 10, the spacer 320 on the right side of the drawing is shown in the first configuration. Each spacer includes a second surface 380 opposite the first surface 344. Each second surface 380 includes ridges 374 that engage the outer member 334 in the first configuration. In addition, the cylindrical sections 386 pass through the holes 359 in the proximal hubs 348 to permit the second surfaces 380 to define an interference fit with the outer member 334 in the first configuration. The interference fit fixes the outer member 334 relative to the inner axle 322 and the rotatable assembly 312. Both of the second surfaces 380 are preferably positioned adjacent the outer member 334 to balance the rotatable performance device, although it may be sufficient to position only one of the second surfaces 380 adjacent the outer member 334 to fix the outer axle 324 relative to the rotatable assembly 312.

Second and still referring to FIG. 10, the spacer 320 on the left side of the drawing is shown in the second configuration. The cylindrical sections 386 enter the bearing 332 and engage the ends 378 of the intermediate section 330 in the second configuration. As a result, gaps are provided between the end surfaces 338 of the outer member 334 and the first surfaces 344 of the spacers 320. The gaps preferably define a loose fit with the outer member 334 in the second configuration. As a result, the first surfaces 344 provide a configuration in which the outer member 334 and the bearing 332 can rotate relative to the inner axle 322.

Regarding the fourth embodiment of the device, it should be noted that the recesses 340 preferably do not have shoulders 41 (FIG. 3) because the ridges 374 and the inserts 382 provide the first and second configurations of the device, respectively. However, other components, such as the lobe bodies 346, the proximal hubs 348, the distal hubs 350, and the access handles 352 are generally identical to the components described in conjunction with the first embodiment of the device 10.

The fourth embodiment 310 of the device may also be a fixed axle diabolo in a first configuration and a one-way diabolo in a second configuration like the first embodiment 10. In addition, the fourth embodiment 310 is preferably configured to be disassembled by hand due to, for example, the large access handles 352.

All of the embodiments of the rotatable performance device include components that may be created using well-known materials and processes. For example, the spacers, the proximal hubs, the distal hubs, the access handles, and the lobe bodies may be plastic components formed in injection molding processes. As another example, the outer member and the inner axle may be metal components formed in machining processes. Alternatively, the outer axle may be a one-way bearing that is used in current one-way diabolo designs, and therefore, the outer axle may be purchased from a supplier.

Although the rotatable performance device is primarily discussed as including reconfigurable spacers, other components may be used to reconfigure the device. For example, switches, levers, keys, pins, clutches, fasteners, springs and the like may be used to reconfigure the device. In any case, outer axle is configurable from a first configuration to a second configuration and vice versa. In the first configuration the outer axle is fixed relative to the rotatable assembly, and in the second configuration the outer axle is rotatable relative to the rotatable assembly. Further still, although the rotatable performance device is primarily discussed in the context of diabolos, the present invention may also be used to provide similar results with other devices such as yo-yos. Such a yo-yo, for example, could be a fixed axle yo-yo in a first configuration and a rotatable axle yo-yo in a second configuration.

It is specifically intended that the present invention not be limited to the embodiments and illustrations contained herein, but include modified forms of those embodiments including portions of the embodiments and combinations of elements of different embodiments as come within the scope of the following claims.

I claim:

1. A rotatable device for performing maneuvers as the rotatable device rotates, comprising:

a rotatable assembly including a first lobe and a second lobe;

an intermediate assembly between the first lobe and second lobe, the intermediate assembly including an outer axle configured to engage a string during use of the device; and a first annular spacer disposed between the intermediate assembly and the first lobe, the first annular spacer being manually repositionable by a user such that, in a first configuration, the first annular spacer defines an interference fit with the intermediate assembly to fix the outer axle relative to the rotatable assembly and, in a second configuration, the first annular spacer defines a loose fit with the intermediate assembly to permit the outer axle to rotate relative to the rotatable assembly.

2. The rotatable device of claim 1, wherein the intermediate assembly further includes an inner axle within the outer axle, and the inner axle being fixed to the rotatable assembly in both the first and second configurations.

3. The rotatable device of claim 1, wherein the outer axle includes a one-way bearing configured to rotate relative to the rotatable assembly only in a first direction.

4. The rotatable device of claim 1, wherein the first annular spacer includes a first surface defining a loose fit with the intermediate assembly in the second configuration wherein the first annular spacer is reversed relative to the first configuration.

5. The rotatable device of claim 4, wherein the intermediate assembly includes an inner axle connecting the first lobe and the second lobe.

6. The rotatable device of claim 5, wherein the intermediate assembly includes a one-way bearing disposed radially outwardly relative to the inner axle and being rotatable relative to the inner axle only in the second configuration in a first direction, and the outer axle is disposed radially outwardly relative to the one-way bearing and fixed relative to the one-way bearing.

7. The rotatable device of claim 5, wherein the first lobe includes an access handle with a first internal threaded section, and the inner axle includes a first external threaded section at a first end connected to the first internal threaded section, and wherein the access handle is rotatable to disengage the first internal threaded section from the first external threaded section.

8. The rotatable device of claim 5, wherein the first surface of the first annular spacer includes an insert and the inner axle includes an intermediate section, and wherein the insert engages the intermediate section to define a gap between the first surface and the outer axle to provide the loose fit with the outer axle in the second configuration.

9. The rotatable device of claim 8, wherein the first annular spacer includes a second surface opposite the first surface, the second surface includes a recess, and a portion of the intermediate section of the inner axle is disposed within the recess in the first configuration.

10. The rotatable device of claim 5, further comprising a second annular spacer between the second lobe and the outer axle, the second annular spacer being disposed radially outwardly relative to the inner axle, and the second annular spacer including a first surface.

11. The rotatable device of claim 5, wherein the first lobe includes a recess, and the first annular spacer is disposed within the recess.

12. A rotatable device for performing maneuvers as the rotatable device rotates, comprising:

a first shell assembly;

a second shell assembly opposite the first shell assembly;

an inner axle connecting the first shell assembly and the second shell assembly;

an outer axle disposed radially outwardly relative to the inner axle and being rotatable relative to the inner axle;

a first annular spacer disposed between the first shell assembly and the outer axle, and the first annular spacer disposed radially outwardly relative to the inner axle;

wherein the first annular spacer is configurable to be oriented in a first configuration in which the first annular spacer engages the outer axle to fix the outer axle relative to the inner axle, and the first annular spacer is configurable to be oriented in a second configuration in which the first annular spacer permits the outer axle to rotate relative to the inner axle;

wherein the outer axle includes a one-way bearing and an outer member, the one-way bearing disposed radially outwardly relative to the inner axle and being rotatable relative to the inner axle in the second configuration only in a first direction, and the outer member disposed radially outwardly relative to the one-way bearing and being fixed relative to the one-way bearing.

13. The rotatable device of claim 12, wherein the first shell assembly includes a first internal threaded section, the second shell assembly includes a second internal threaded section, and the inner axle includes a first external threaded section at a first end, a second external threaded section at a second end, and an intermediate section between the first external threaded section and the second external threaded section, wherein the first external threaded section is in engagement with the first internal threaded section, and the second external threaded section is in engagement with the second internal threaded section.

14. The rotatable device of claim 13, wherein the first shell assembly includes a first lobe body, and an access handle within the first lobe body, the access handle including the first internal threaded section, and wherein the access handle is rotatable relative to the first lobe body to disengage the first internal threaded section from the first external threaded section.

15. The rotatable device of claim 14, wherein the access handle has a dimension that is at least five times a diameter of the inner axle.

16. The rotatable device of claim 1, wherein the intermediate assembly defines an axis about which the rotatable assembly rotates, and in the second configuration an orientation of the first annular spacer along the axis is reversed relative to the first configuration.

17. The rotatable device of claim 1, wherein the intermediate assembly defines an axis about which the rotatable assembly rotates and the first annular spacer includes a first surface, in the first configuration the first surface faces axially away from the outer axle, and in the second configuration the first surface faces axially toward the outer axle.

18. A rotatable device for performing maneuvers as the rotatable device rotates, comprising:

a first shell assembly;

a second shell assembly opposite the first shell assembly;

an inner axle connecting the first shell assembly and the second shell assembly;

an outer axle disposed radially outwardly relative to the inner axle and being rotatable relative to the inner axle;

a first annular spacer disposed between the first shell assembly and the outer axle, and the first annular spacer disposed radially outwardly relative to the inner axle;

wherein the first annular spacer is configurable to be oriented in a first configuration in which the first annular spacer engages the outer axle to fix the outer axle relative to the inner axle, and the first annular spacer is configurable to be oriented in a second configuration in which the first annular spacer permits the outer axle to rotate relative to the inner axle;

wherein the inner axle defines an axis about which the first shell assembly and the second shell assembly are rotatable relative to the outer axle, and in the second configuration an orientation of the first annular spacer along the axis is reversed relative to the first configuration.

19. The rotatable device of claim 12, wherein the inner axle defines an axis about which the first shell assembly and the second shell assembly are rotatable relative to the outer axle and the first annular spacer includes a first surface, in the first configuration the first surface faces axially away from the outer axle, and in the second configuration the first surface faces axially toward the outer axle.

* * * * *